United States Patent [19]

Goldstein

[11] Patent Number: 4,669,277

[45] Date of Patent: Jun. 2, 1987

[54] CORRUGATED PLATE HEAT EXCHANGER

[75] Inventor: Vladimir L. Goldstein, Woodbridge, Canada

[73] Assignee: Sunwell Engineering Company Ltd., Woodbridge, Canada

[21] Appl. No.: 897,806

[22] Filed: Aug. 19, 1986

[51] Int. Cl.[4] ..... F25C 1/14

[52] U.S. Cl. ..... 62/354; 165/94; 15/256.5

[58] Field of Search ..... 62/354; 165/94, 165; 15/256.5; 366/309, 311, 312

[56] References Cited

U.S. PATENT DOCUMENTS

| | | | |
|---|---|---|---|
| 1,930,570 | 10/1933 | Taylor | 62/354 |
| 2,259,841 | 10/1941 | Spiegl | 62/67 |
| 2,280,320 | 6/1942 | Taylor | 62/354 X |
| 3,191,398 | 6/1965 | Rader | 62/354 X |
| 3,328,972 | 7/1967 | Svanoe | 62/123 |
| 4,059,047 | 11/1977 | Sollick | 62/354 X |
| 4,271,682 | 6/1981 | Seki | 62/354 |

*Primary Examiner*—William E. Tapolcai

*Attorney, Agent, or Firm*—Spencer & Frank

[57] ABSTRACT

An ice-making machine includes a plurality of heat exchangers disposed inside a housing and each having an inlet and an outlet to permit circulation of coolant therethrough. Each of the heat exchangers includes a pair of oppositely directed, corrugated heat exchange surfaces to transfer heat from the fluid within the housing to the coolant. Ice-making regions are disposed between the heat exchangers. These regions each have an inlet and an outlet to enable fluid to circulate therethrough. Blade assemblies are provided in each of the ice-making regions to co-operate with the heat exchangers to inhibit deposition of ice on the heat exchangers. These blade assemblies each include at least one blade of complementary shape to the corrugated heat exchange surfaces to contact respective ones of the surfaces. The blade assemblies are rotatable about an axis generally perpendicular to the plane containing the surfaces. Drive means rotate the blade assemblies at a rate such that the interval between successive passes of the blades in insufficient to permit crystallization of ice on the surfaces.

12 Claims, 11 Drawing Figures

CORRUGATED PLATE HEAT EXCHANGER

This invention relates to ice-making machines and more particularly to a corrugated plate heat exchanger for use in an ice-making machine.

U.S. patent application Ser. No. 739,225, the content of which is incorporated herein by reference, discloses a heat exchanger suitable for making ice. This heat exchanger consists of a housing having a fluid inlet and outlet. Disposed in this housing are a plurality of heat exchangers, each having an inlet and an outlet to permit circulation of coolant therethrough. Each heat exchanger has a pair of oppositely directed heat exchange surfaces to allow heat exchange between the fluid within the housing and the coolant. A blade assembly is mounted on a rotatable shaft extending through the centre of the housing. The blade assembly consists of a disk with a plurality of blades attached on either side thereof by hinges. The blades on one side are directed towards the surface of one heat exchanger, and the blades on the other side are directed towards the surface of another heat exchanger. These blades scrape the surface of the heat exchangers to inhibit crystallization of ice thereon.

Is is object of the present invention to improve the efficiency of the heat exchangers described above.

Accordingly, the invention provides an ice-making machine which includes a plurality of heat exchangers disposed inside a housing, each having an inlet and an outlet to permit circulation of coolant therethrough. Each of the heat exchangers includes a pair of oppositely directed, corrugated heat exchange surfaces to transfer heat from the fluid within the housing to the coolant. Ice-making regions are disposed between the heat exchangers. These regions each have an inlet and an outlet to enable fluid to circulate therethrough. Blade assemblies are provided in each of the ice-making regions to co-operate with the heat exchangers to inhibit deposition of ice on the heat exchangers. These blade assemblies each include at least one blade of complementary shape to the corrugated heat exchange surfaces to contact respective ones of the surfaces. The blade assemblies are rotatable about an axis generally perpendicular to the plane containing the surfaces. Drive means rotate the blade assemblies at a rate such that the interval between successive passes of the blades is insufficient to permit crystallization of ice on the surfaces.

The use of a corrugated heat exchanger in the present invention provides the advantage of increased heat transfer area and improved rigidity for the surface. The corrugated heat exchange surface does not tend to warp as easily as a flat heat exchange surface, thus wear on the blades is reduced. The complementary-shaped blades are used to scrape the heat transfer surfaces to ensure that no ice crystallizes on the surface of the heat exchanger.

The invention will now be described, by way of illustration only, with reference to the following drawings in which.

Figure 1:
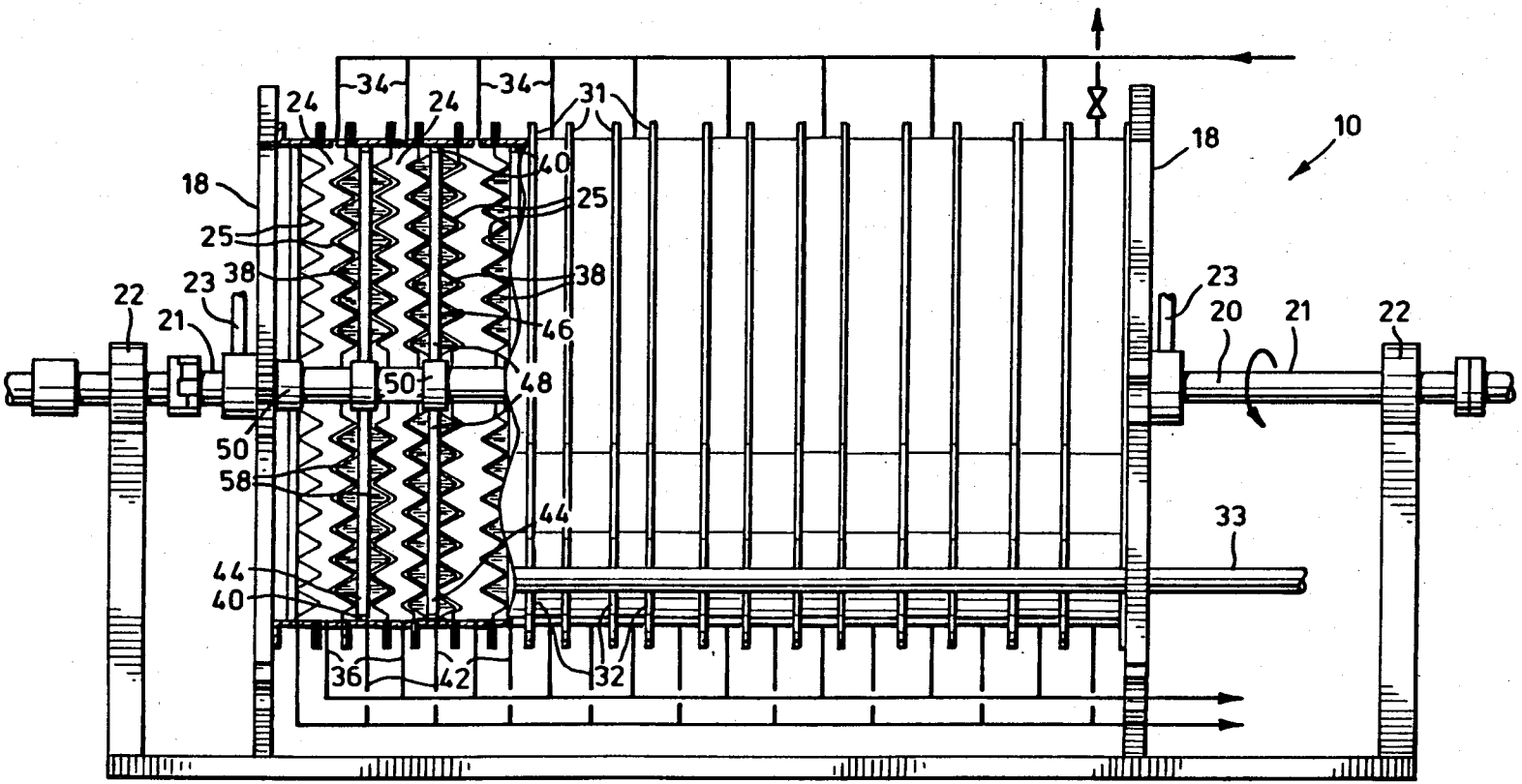
FIG. 1 is a front view of a heat exchanger in partial cross-section.
Figure 2:
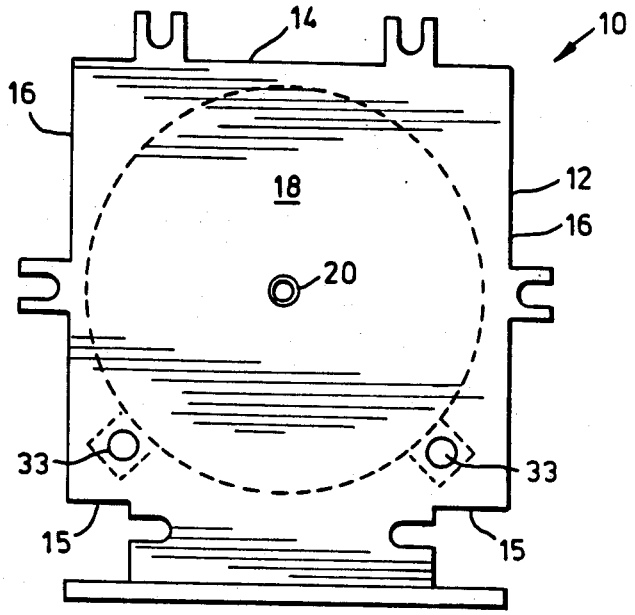
FIG. 2 is a side view of the heat exchanger of FIG. 1.

Referring to FIGS. 1 and 2, it can be seen that the ice-making machine 10 includes a housing 12 having a top wall 14, side walls 16 and end walls 18. The end walls 18 are square when viewed in plan and co-operate with the top wall 14, bottom walls 15 and side walls 16 to define an enclosure.

A hollow agitator shaft 20 with open ends 21 each of which are rotatably connectable to a respective brine inlet pipe 23, extends through the housing between the end walls 18. This shaft is rotatably supported at opposite ends by bearings 22 located outside of the housing and is rotatable by a motor.

Figure 3:
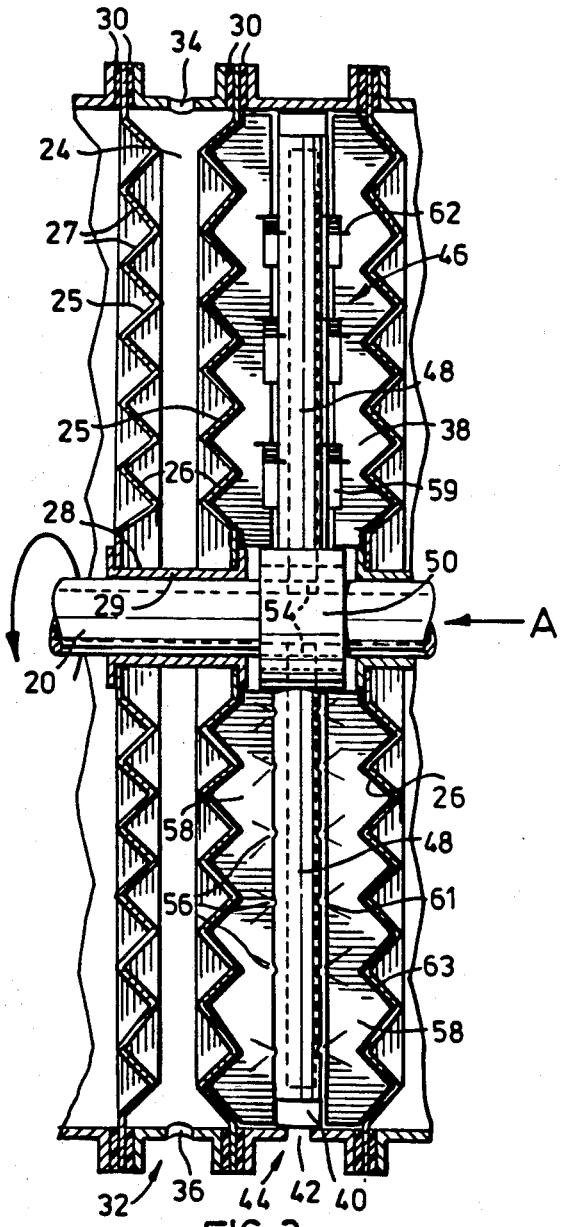
FIG. 3 is a cross-sectional view of a portion of the heat exchanger of FIG. 1.
Figure 4:
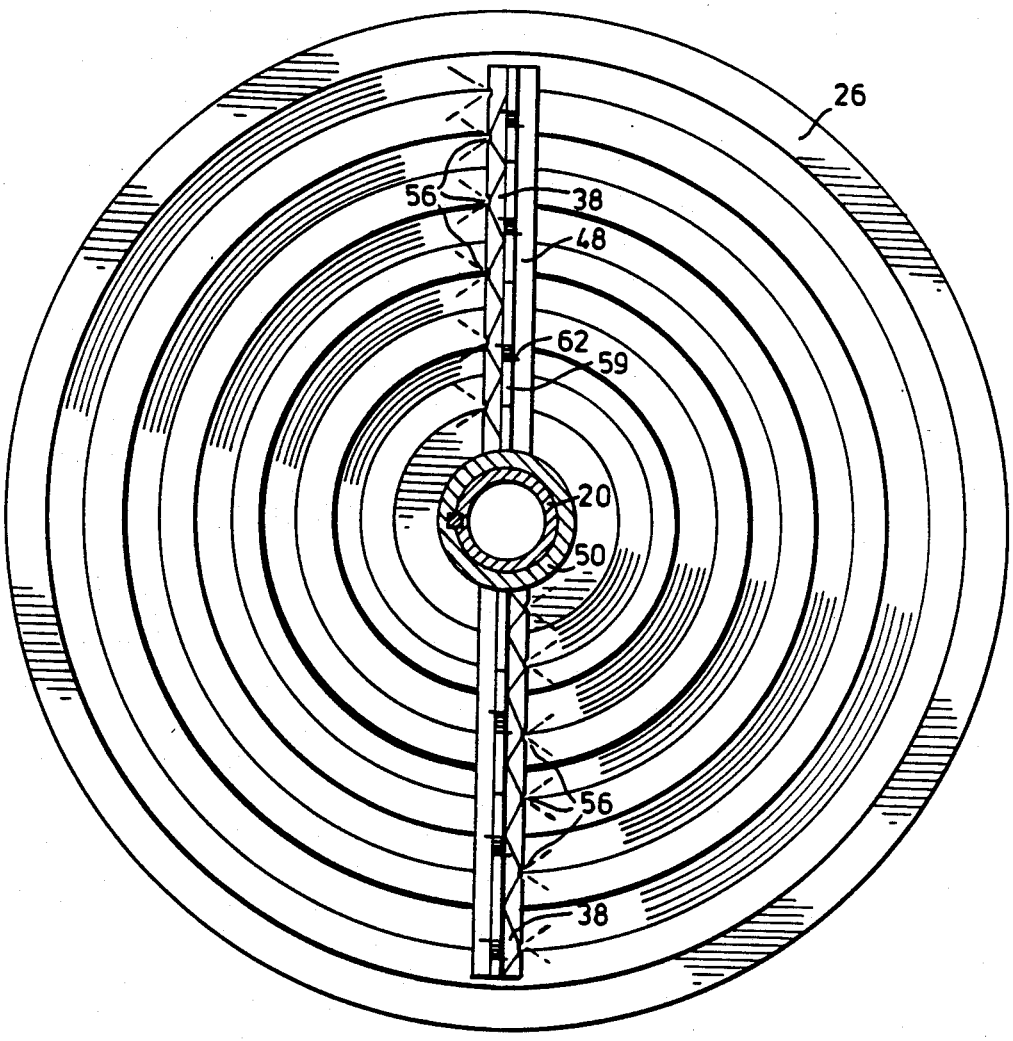
FIG. 4 is a view in the direction of the arrow A in FIG. 3.

As can best be seen in FIGS. 1 and 3, a plurality of heat exchangers 24 are located at spaced intervals within the housing 12. Each heat exchanger 24 consists of a pair of circular plates 25 with apertures 28 therein to accommodate the shaft 20, spaced apart by inner and outer gaskets 29, 30. These plates 25 have corrugations 27 which extend in the circumferenrial direction as can best be seen in FIG. 4 to provide corrugated heat exchange surfaces 26. The plates 25 are each supported near their bottom ends 32 by a pair of supports 33 extending inside the housing 12 along the length of the housing 12. Each heat exchanger 24 has an inlet 34 on the top end 31 thereof and an outlet 36 at the bottom end 32 thereof.

Disposed between each pair of heat exchangers 24 are ice-making regions 38, each of which are defined at their outer peripheries by a respective spacer 40. Ourlets 42 are located at the bottom end 44 of each region. A blade assembly 46 is situated in each ice-making region 38. Each blade assembly 46 includes a pair of arms 48 mounted generally perpendicular to the shaft 20 on a collar 50 fixed to tne shaft 20. These arms 48 communicate with the shaft 20 through openings 54 in the shaft 20. The arms 48 are tubular and have a plurality of spaced openings 56 along the length thereof. Two blades 58 extending along substantially the entire length of the arms are pivotally connected to each of the arms 48 by hinges 59. As can be seen in FIGS. 3 and **5*a*, each blade 58 consists of a plate having a generally straight edge 61 which is hinged to an arm, and a notched edge 63 shaped to conform to the shape of the surface 26 of the heat exchanger. One blade 58 is hinged to the side of the arms 48 disposed towards the heat exchanger surface 26 of one heat exchanger, and another blade 58 is attached to the side of the arms disposed towards the heat exchange surface of an adjacent heat exchanger. Torsion springs 62 are connected to the blades 58 and arms 48 to bias the blades 58 in scraping relation with a respective heat exchange surface 26**.

In operation, brine is fed into both ends 21 of the agitator shaft 20. The brine passes through tne openings 54 in the shaft 20 into the arms 48, and enters the ice-making regions through openings 56 in the arms 48. Refrigerant enters each of the heat exchangers 24 through the inlets 34 and exits through the outlets 36. As the refrigerant passes through the heat exchangers 24 it absorbs heat through the heat exchange surfaces 26 and boils. The brine in contact with the heat exchange surfaces 26 is thus supercooled. To avoid deposition of ice on the surfaces 26 which would inhibit heat transfer, the blade assemblies are rotated by the shaft 20. Rotation of the shaft 20 rotates the arms 48 and thereby sweeps the blades 58 over respective heat exchange surfaces 26. Movement of the blades removes the supercooled brine from adjacent the surfaces 26 and distributes it through the body of the brine solution. The supercooled brine will crystallize on centres of crystallization present in the solution and in turn acts as new centres for crystallization to generate 3-dimensional crystallization of the water within the brine solution and thus promotes the formation of ice in a crystalline manner. The brine solution with the crystallized ice in suspension is extracted from the outlets 42.

Figure 5A:
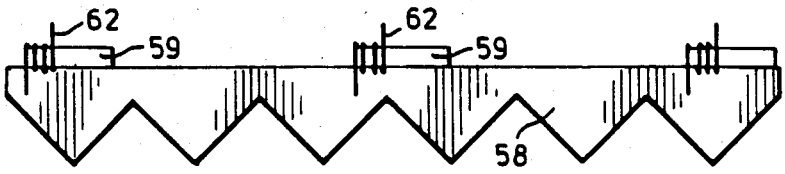
FIG. 5A is a front view of a blade assembly to be used in the heat exchanger of FIG. 2.
Figure 5B:
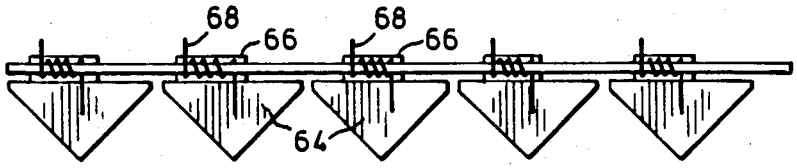
FIG. 5B is a front view of an alternative embodiment of a blade assembly to be used in the heat exchanger of FIG. 1.

FIGS. 5B to F show three alternative embodiments of the blade shown in FIG. 5A. In FIG. 5B, instead of using a single blade, several triangular blade segments 64 corresponding in shape to the corrugated heat exchange surfaces 26 are each pivotally connected to an arm 48 by a respective hinge 66. A torsion spring 68 is associated with each segment 64 to bias the segments 64 towards a heat exchange surface 26*a*.

Figure 5C:
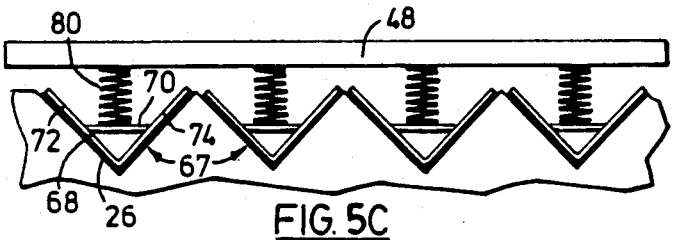
FIG. 5C is a front view of another alternative embodiment of a blade assembly to be used in the heat exchanger of FIG. 1.
Figure 5D:
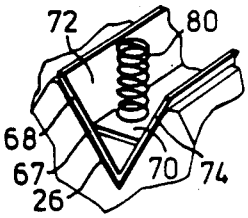
FIG. 5D is a perspective view of the blade assembly of FIG. 5C.

FIGS. 5C and D show another alternative embodiment of the blades. In this embodiment there are several blade segments 67 which are each made up of a flat metal strip 68 bent into a "V" shaped formation corresponding in shape to the shape of the heat exchange surfaces 26. A plate 70 extends between and is attached to opposite sides 72, 74, of each "V" shaped strip. A coil spring 80 is attached to each plate 70 at one end and to an arm 48 at the other end. The springs 80 bias each strip 68 towards the heat exchange surface 26 such that each strip 68 is disposed at an angle to the surface with the edge of the strip 68 in contact with the heat exchange surface 26, as can be seen in FIG. 5D.

Figure 5E:
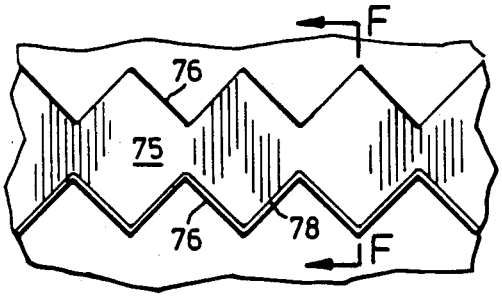
FIG. 5E is a front view of still another alternative embodiment of a blade assembly.
Figure 5F:
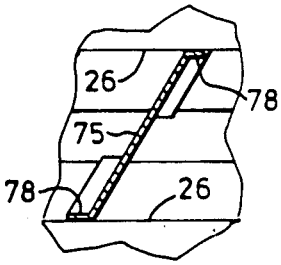
FIG. 5F is a cross-sectional view along line F—F of FIG. 5E.
Figure 5G:
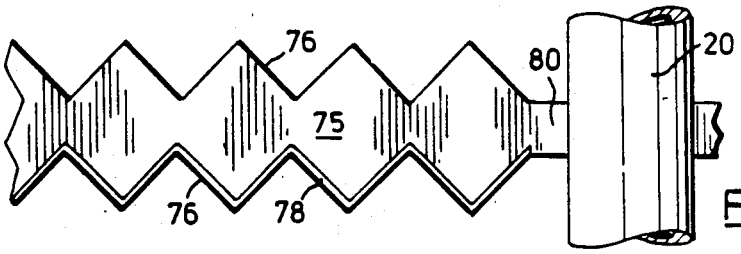
FIG. 5G is a front view of the blade of FIG. 5E attached to a shaft.

FIGS. 5E, F and G show another embodiment wherein the blade 75 is wider than the ice-making region, and has corrugated edges 76 with corrugated lip portions 78 depending from the edges 76. These edges 76 correspond in shape to the shape of the heat exchange surfaces 26 defining the ice-making regions. The blade assembly has an end portion 80 of reduced thickness (FIG. 5G) extending from the blade which is attached to the shaft 20, rather than to an arm 48. The blade is twisted at an angle to the end portion 80 to fit between the heat exchange surfaces defining the ice-making region, so that the edges 76 and the lip portions 78 contact respective opposed heat exchange surfaces 26. The end portion 80 exerts a torsional force on the blade 75 to bias the blade 75 against the heat exchange surfaces 26.

It is to be appreciated that changes can be made to the preferred embodiments of the invention within the scope of the invention as described and claimed. There can be any number of heat exchangers 24 and ice-making regions 38. There could be one inlet for tne ice-making regions 38 and one outlet, with fluid communication between ice-making regions. Also, the blades 58 could be carried by rotating disks instead of arms 48.

We claim:

1. An ice-making machine comprising a housing, a plurality of heat exchangers disposed in said housing and each having an inlet and an outlet to permit circulation of coolant therethrough, each of said heat exchangers including a pair of oppositely directed corrugated heat exchange surfaces to transfer heat from fluid within said housing to said coolant, ice-making regions disposed between said heat exchangers each having an inlet and an outlet to enable fluid to circulate therethrough, blade assemblies located in each of said ice-making regions to co-operate with said heat exchangers to inhibit deposition of ice on said heat exchangers, said blade assemblies each including at least one blade of a complementary shape to said corrugated heat exchange surface to contact respective ones of said surfaces, each of said blade assemblies being rotatable about an axis generally perpendicular to a plane containing said surfaces, and drive means to rotate said blade assemblies at a rate such that the interval between successive passes of said blade assemblies is insufficient to permit crystallization of ice on said surfaces.

2. An ice-making machine according to claim 1 wherein one surface of one of said heat exchangers is directed toward one surface of another of said heat exchangers and each of said blade assemblies includes two pairs of blades supported on a common carrier and rotatable in unison, one pair of blades being directed toward one of said heat exchangers and the other pair of blades being directed toward the other of said heat exchangers.

3. An ice-making machine according to claim 2 wherein each of said blades are moveable about an axis parallel to said heat exchange surface into engagement with said surface.

4. An ice-making machine according to claim 3 wherein said common carrier is an arm supported by a rotatable shaft extending through said housing.

5. An ice-making machine according to claim 4 wherein said blades are inclined to the plane of the heat exchange surfaces.

6. An ice-making machine according to claim 5 wherein said blades are pivotally mounted on said arm.

7. An ice-making machine according to claim 5 wherein each of said blades is biased towards said heat exchange surfaces by biasing means.

8. An ice-making machine according to claim 7 wherein each pair of blades comprises a blade extending across the entire length of said arm.

9. An ice-making machine according to claim 7 wherein each pair of blades comprises a plurality of blade segments, each segment extending across only a portion of the length of said arm and being pivotally connected to said arm, said segments extending across the entire length of said arm.

10. An ice-making machine according to claim 9 wherein said blade segments comprise a plurality of flat plate strips formed to correspond to the shape of said heat exchange surface, each strip being connected at one edge to said arm by a coil spring such that said edge contacts said heat exchange surface.

11. An ice-making machine according to claim 1 wherein said blade is a flat plate having edges corresponding in shape to the shape of said heat exchange surfaces and lip portions depending from said edges, said blade extending between opposed heat exchange surfaces in said ice-making region at an angle.

12. An ice-making machine according to claim 11 wherein said blade is connected to an end portion of reduced width which is mounted on a rotatable shaft extending through said housing, said end portion extending at an angle to said blade and imposing a torsional force on said blade to bias said blade towards said heat exchange surfaces.

* * * * *